United States Patent [19]

Stockhausen et al.

[11] Patent Number: 4,631,063

[45] Date of Patent: Dec. 23, 1986

[54] PROCESS FOR FINISH DRESSING MINERALLY DRESSED LEATHERS OR THOSE DRESSED BY A COMBINED METHOD, USING POLYMER DRESSINGS

[75] Inventors: Dolf Stockhausen; Rudolf Nowak; Miroslav Chmelir; Manfred Kaussen, all of Krefeld; Kurt Dahmen, Monchen-Gladbach, all of Fed. Rep. of Germany

[73] Assignee: Chemische Fabrik Stockhausen GmbH, Krefeld, Fed. Rep. of Germany

[21] Appl. No.: 720,661

[22] Filed: Apr. 8, 1985

[30] Foreign Application Priority Data

Apr. 9, 1984 [DE] Fed. Rep. of Germany ..... 3413301

[51] Int. Cl.[4] ..... C14C 5/00

[52] U.S. Cl. ..... 8/94.21; 8/94.2

[58] Field of Search ..... 8/94.21, 94.22, 94.23

[56] References Cited

U.S. PATENT DOCUMENTS 3,898,037 8/1975 Lange ..... 422/16

FOREIGN PATENT DOCUMENTS 1669347 5/1971 Fed. Rep. of Germany .

2836289 1/1979 Fed. Rep. of Germany .

*Primary Examiner*—Paul Lieberman

*Assistant Examiner*—John F. McNally

*Attorney, Agent, or Firm*—Sprung Horn Kramer & Woods

[57] ABSTRACT

A process for the finish dressing of leathers dressed by a mineral or a combined method, by treatment with an aqueous solution of water soluble polymer dressing substances that are polymers of unsaturated monomers that contain sulfonic groups. These polymers contain, if necessary, additional basic units that do not affect the water solubility, these being derived from the comonomers that can be copolymerized with the monomers that contain the sulfonic groups and which do not contain phosphorus.

9 Claims, No Drawings

PROCESS FOR FINISH DRESSING MINERALLY DRESSED LEATHERS OR THOSE DRESSED BY A COMBINED METHOD, USING POLYMER DRESSINGS

The present invention relates to a method for finish dressing leathers that have been dressed minerally or by a combined method, using polymer dressing materials.

For the most part, the main dressing of leathers is carried out with basic salts of trivalent chromium, aluminum and/or zirconium alone or in combination with synthetic dressing materials. A subsequent finishing dressing serves primarily to improve or modify specific characteristics of the leather, which are characterized by terms such as fullness, scuff-resistance, feel, surface fissuring, equality, and others. Accordingly, there are important differences between the objectives of main and finishing dressing.

In the finish dressing process, synthetic finishing materials—syntanes—are used in addition to vegetable substances, and the dressing effect of these can be limited. Typical representatives are low molecular (polymerisation degree of 1–5) condensation products of formaldehyde with naphthalene and/or phenolsulfonic acids or the alkali salts of these. A frequent disadvantage of polymers that contain carboxyl groups in the dressing process is their clearly defined pH sensitivity in the application range common in practice of between 3 and 5, and their frequent lack of stability in comparison with the electrolyte concentrations that occur in finishing dressing. These disadvantages frequently lead to a surface crinkling or to smearing, with all the resulting consequences for later processes, such as dyeing, for example. For a number of years, polymers containing carboxyl groups and copolymers based on acrylic acid have also been used. As a rule, the polycarboxylates in combination with other suitable finishing materials have been used.

It is the task of the present invention to improve the formerly known products used for finish dressing, in particular with regard to pH sensitivity, electrolytic stability and effect on the colour behaviour of the leather.

The object of the present invention is a process for the finish dressing of leather that has been dressed using a mineral or combined process, this being done by treatment with an aqueous solution of water soluble polymer dressing materials, characterized in that polymers of at least one unsaturated monomer that contains an unsaturated sulfonic acid group and if necessary a further water soluble copolymerisable unsaturated monomer that contains no phosphorus is used as the polymer dressing substance.

The incorporation of monomers that contain sulfonic acid groups in the polymers used according to the present invention results in much more favourable application characteristics. Whereas syntanes and the formerly known polycarboxylates frequently lead to undesirable lightening in dyed leathers, the polymers according to the present invention do not—surprisingly—have these disadvantages. Despite the presence of sulfone groups, most surprisingly, during the subsequent dyeing of the leather with anionic dyes there is no undesired change in the desired colour tone cause by lightening.

Unsaturated monomers that contain sulfonic-groups used for the production of the polymer dressing material according to the present invention are those that derive from $\alpha$-$\beta$ unsaturated acids and their derivatives, preferably of (meth)acrylic acids and their derivatives, such as, for example, 2-acrylamido-2-methylpropanesulfonic acid. Further examples for sulfonic acids of this kind are N-(3-sulfo-propyl-N-(meth)-acrylamidopropyl)-N,N-dimethylammonium betane or a sulfopropyl (meth)acrylic acid ester.

The sulfon-group can also be present in a cyclic, preferably aromatic system as a substituted group, whereas the polymerisable double CC bond in the side chain of the cyclic system, as in the ring sulfonized aromatic $\alpha$-olefins. A typical example for this is styrylsulfonic acid. Not only are the sulfonic acids themselves suitable; their salts, such as the alkali and/or ammonium salts are also suitable.

The content of sulfonic acid containing monomers in the polymers used for finish dressing amounts at least to 3 mol-%, preferably 5 mol-%.

In addition to the basic units that are derived from the monomers that contain sulfonic acid groups, the polymers according to the present invention can also contain additional basic units that do not inhibit the water solubility of the polymers, these being derived from the corresponding copolymerisable monomers that do not contain phosphorus. Preferred polymers are mixed polymers of at least one monomer that contains a sulfonic group with at least one monomer that contains a carboxyl group. These mixed polymers can, for their part, can contain basic units derived from other water soluble, unsaturated monomers. As monomers that contain carboxyl groups it is in the first line the unsaturated carboxylic acids such as maleic acid as dicarboxylic acid as well as the unsaturated monocarboxylic acids such as (meth)acrylic acid and/or crotonic acid that are suitable.

In addition, (meth)acrylamide or vinylpyrrolidone can be built into the polymer dressing substances according to the present invention as additional copolymerisable monomers that do not affect the water solubility.

The molecular weight of the polymer dressing substances according to the present invention can vary within very wide limits. Suitable are polymers with molecular weights from 10,000 g/mol. The upper limits of the molecular weight can, for example, be 150,000 g/mol. It is preferred that the molecular weight range for the polymers that are used be between 20,000 and 100,000, in particular between 25,000 and 50,000 g/mol.

The molecular masses were calculated from the border viscosities established in 10% aqueous common salt solutions according to the relationship of Korotkinha (O. Z. Korotkinha et al, Zh. Prikl, Khim. 38, 2533, 1965)

$$[\eta]=2{,}5\cdot 10^{-2}\cdot M^{0{,}7}$$

wherein $[\eta]$ is the border viscosity in ml/g and M is the molecular mass in g/mol.

The finish dressing of the leather takes place preferably with 0.1–5.0 %-wt. relative to the fold weight of the polymer dressing substance at a dye-bath length of up to 300%, temperatures of up to a maximum of 70° C. and pH values in the range of at least 2.5–8.0.

EXAMPLE 1

Polymer dressing substance of acrylic acid/acrylamide/and 2-acrylamido-2-methylpropane sulfonic acid.

100 g deionized water, 2.5 g acrylic acid, and 1.6 g hydrogen peroxide (35%) are placed in a polymerisation flash fitted with a stirrer, a thermometer, and a reflex column and heated to 90° C. In another vessel, the monomer solution was produced from 135 g acrylic acid, 86 g acrylamide, 72 g 2-acrylamido-2-methyl-propane sulfonic acid (AMPS) and 240 g water. The monomer solution was then introduced while being stirred into the polymerisation flash for approximately 60 minutes. At the same time 7.2 g hydrogen peroxide (35%), 1.6 g hydroxylaminhydrochloride (dissolved in 12 g water) and 60 g 45% sodium hydroxide was added in proportion to the monomer solution. The reaction temperature was maintained by simmering at 100° C. After termination of the polymerisation, stirring was continued for a further hour at 100° C. and then the pH was adjusted to 7.4. This yielded approximately 40% solution of a solution of a polymer of acrylic acid, acrylamide and AMPS with a viscosimetrically determined molecular mass of 48,000 g per mol.

The solution that was obtained was used for finish dressing in accordance with the following:

| | | |
|---|---|---|
| Type: | upper leather<br>Wet blue, fold strength 2.0–2.2 mm pH 5.3,<br>Ts: 100° C. %-data relative to fold weight. | |
| Wash: | 200% water 35° C.<br>0.5 acetic acid 1:5 diluted with water | 10 min |
| Drain off dye bath | | |
| Neutralisation: | 100% water 35° C. | |
| Finish dressing | 2% Tanigan PC*, undissolved<br>pH 4.5 | 45 min |
| | Leather cross section against Bromocresol green:blue green<br>+3% polymer dressing substance 1:1 diluted with water | 30 min |
| | +1.5% chrome dressing substance 26% 33% basic, undissolved<br>+3% polymer dressing substance 1:1 diluted with water | 30 min |
| | +3% Tanigan 3LN**, undissolved<br>pH 4.5 | 30 min |
| Drain off dye bath | | |
| Rinse | water 60° C. | 5 min |
| Dyeing | 1% dye C.I. acid brown 83, 1:20 suspended in water | |
| Oiling | 2× after 10 min, 1× after 20 min<br>+8% of a sulfonated triglyceride with paraffin sulfonate 1:4 in water | 45 min |
| | +1% formic acid 1:5 in water<br>pH 3.4 | 30 min |
| Drain off dye bath | | |
| Rinse | water 20° C. | 5 min |
| Leather racked overnight | | |
| Samming | | |
| Vacuum dry | | |
| Air dry | | |
| Moisten | | |
| Staking | | |

*light-fast synthetic neutralisation dressing substance from BAYER AG
**highly light-fast synthetic white dressing substance, BAYER AG The leather treated with the polymer dressing substance according to the present invention displays good to very good body and softness with good scuff resistance, and was deeper dyed than leather treated with a commercial polymer finish dressing substance based on acrylic acid/acrylamide/copolymerisate.

EXAMPLE 2

The polymerisation of acrylamide, acrylic acid and 2-acrylamido-2-methylpropanesulfonic acid took place in the same manner as in Example 1, with the difference that the quantities of acrylamide, acrlic acid and AMPS varied to some degree. In addition, the desired molecular masses were achieved by corresponding changes in the concentrations of hydrogen peroxide and hydroxylamine. The concentration, the molecular masses and the catalyst concentrations are set out in Table 1.

| Product | Pol 2 | Pol 3 | Pol 4 | Pol 5 |
|---|---|---|---|---|
| Molecular ratio acrylic acid/ acrylamide/ AMPS | 55/35/10 | 55/35/10 | 60/35/5 | 60/35/5 |
| Molecular mass (g/mol) | 19.500 | 96,000 | 25,000 | 39,000 |
| Catalysts: | | | | |
| $H_2O_2$(35%) | 44.0 g[a] | 4.4 g[b] | 8.8 g[b] | 6.6 g[c] |
| $NH_2O_4$.HCL | 8.0 g | 0.8 g | 1.6 g | 1.2 g |
| Starting size | 750 g | 800 g | 800 g | 800 g |

[a]non-neutralized monomer solution
[b]partially neutralized monomer solution as in Example 1

Using the polymer dressing substance with the molecular mass of 25.000 g/mol as in Example 1, a leather was obtained that was distinguished by a deeper colouration than was obtained in a leather treated with a commercial polymer finish dressing substance based on acrylic acid/acrylamide copolymer.

EXAMPLE 3

The polymer dressing substances described in Example 2 were used as follows for treating Napa type cowhide.

| Cowhide. | | |
|---|---|---|
| Napa type: | Wet blue, fold thickness 1.2 mm, pN 6.0, Ts 100° C. % detail related to fold weight | |
| Wash | 200% water 30° C.<br>0.5% acetic acid 1:5 in water | 10 min |
| Run off dye bath | | |
| Neutralisation: | 100% water 30° C. | |
| Finish dressing: | 2% Tanigan PC*, undissolved<br>+ 1% sodium bicarbonate 1:10 suspended in water<br>pH 6.5<br>Leather cross-section against bromcresol green: blue | 15 min |
| | Polymer dressing substance 1:1<br>+4% diluted with water<br>+2% of a sulfated neats foot oil<br>+1% ammonia 25% 1:5 diluted in water | 15 min |
| Dyeing | +5% C.I. Acid brown 326<br>300% water 60° C. | 60 min |
| | 1% formic acid 1:5 diluted in wate<br>pH 6.6 | 30 min |
| Drain off dye bath | | |
| Oiling | 200% water 60° C.<br>1% softening filler as per DP 1 263 976 Example 1, 1:5 dissolved in water<br>+1% C.I. Acid Brown 326 1:20 suspended in water<br>2× after 10 min, 1× after 20 min | 30 min |
| | + 8% of a sulfonated fish oil 1:4 diluted with water | 30 min |
| | +1% formic acid 1:5 diluted in water<br>pH 3.9 | 20 min |
| Drain off dye bath | | |
| Rinse | Water 20° C. | 5 min |
| Leather racked overnight] | | |
| Samming | | |
| Moisten | | |
| Staking | | |
| Milling | | |
| Stretch | | |

*light-fast synthetic neutralisation dressing substance, BAYER AG

The leather treated with the polymer dressing substance according to the present invention is characterized by a deeper colouration than leather treated with a commercial polymer dressing substance based on acrylic acid/acrylamide.

EXAMPLE 4

Polymer dressing substance of acrlic acid, acrylamide and sodium styrol sulfonate.

In a polymerisation flash as described in Example 1, 100 g water, 2.5 g acrylic acid, and 1.0 g hydrogen peroxide (35%) were added and heated to 90° C. The monomer solution consisting of 93.6 g acrylamide, 48.5 g sodium styrol sulfonate (80%) 160 g acrylic acid and 260 g water were metered into the polymerisation flask within 2 hours, together with the hydroxylamine solution (1.6 g in 58 g water), 8 g hydrogen peroxide and 60 g caustic soda (45%). The reaction temperature was kept at 100° C. by simmering. After polymerisation, stirring was continued for a further two hours at 90° C. and neutralized with caustic soda to pH 7.0. The polymer has a viscosimetrically determined molecular weight of 20,000 g/mol.

The polymer dressing substance is used as follows:

| Sheepskin | | |
|---|---|---|
| Type: | Napa | |
| Provenance: | New Zealand, wet blue, thickness: 1.0 mm<br>% details relative to fold weight | |
| De-Oiling: | 300% water 35° C.<br>2% non-ionic emulsifier with chlorinated hydrocarbons | 30 min |
| Drain off dye bath | | |
| Neutralisation | 200% water 35° C.<br>2% sodium acetate, undissolved | 15 min |
| | +0.5% sodium bicarbonate 1:10 suspended in water<br>pH 5.5<br>Leather cross-section against bromocresol green: blue | 30 min |
| Rinse | Water 50° C. | 5 min |
| Finish dressing/Oiling | 200% water 50° C.<br>4% polymer dressing substance 1:1 diluted with water | 30 min 1:4 |
| | +5% sulfonated neats foot oil diluted with water<br>+5% oiling agent based on alkanesulfonate | 30 min |

-continued

| Sheepskin | | |
|---|---|---|
| | +1% formic acid 1:5 diluted with water pH 4 | 30 min |
| Rinse | Water 20° C. | 5 min |
| Rack leather overnight | | |
| Hang to dry | | |
| Moisten | | |
| Staking | | |
| Rub clean | | |

The leather treated according to the present invention was clearly softer for a given scuff resistance than a comparable leather treated with a commercial polymer finish dressing substance based on acrylic acid/acrylamide copolymer.

EXAMPLE 5

Polymer dressing substance of methacrylic acid, acrylamide and sodium styryl sulfonate 100 g water, 2.5 g methacrylic acid and 1.0 g 35% hydrogen peroxide were placed in a polymerisation vessel as described in Example 1 and heated to 90° C.

After polymerisation, stirring was carried on for a further 2 hours at 90° C. and neutralized to pH 7.0 with caustic soda. The tertiary polymer has a viscosimetrically determined molecular weight of approximately 30,000 g/mol.

Used as in Example 4, the polymer dressing described here resulted in increased softness for the same degree of scuff resistance.

EXAMPLE 6

The tertiary polymer described in Example 5 was used as follows for cowhide.

| | | |
|---|---|---|
| | Wet blue, fold thickness 1.7–1.8 mm<br>%-details relative to fold weight. | |
| Wash | 200% water 35° C.<br>0.5% Acetic acid 1:5 diluted with water | 10 min |
| Run off dye bath | | |
| Neutralisation | 100% water 35° C. | |
| Finish dressing | 2% Tanigan PC* undissolved pH 4.7 | 45 min |
| | 3% polymer dressing substance 1:1 diluted with water | 30 min |
| | +1.5% chrome dressing substance 26% 33% basic, undissolved | 30 min |
| | +3% polymer dressing substance 1:1 diluted with water | 30 min |
| | +3% Tanigan 3LN**, undissolved pH 4.7 | |
| Rinse | Water 60 ° C. | 5 min |
| Dyeing/Oiling | 100% water 60° C.<br>1% Dye, C.I. Acid brown 83 1:20 suspended in water<br>2× after 10 min, 1× after 20 min | |
| | +8% of a neats foot oil sulfonate with 80% working substance and a content of organic $SO_3$ of approx. 5% 1:4 diluted in water | 45 min |
| | +1% formic acid 1:5 diluted with water pH 3.4 | 30 min |
| Rinse | Water 20° C. | 5 min |
| Leather racked overnight | | |
| samming | | |
| hang dry | | |
| moisten | | |
| staking | | |
| stretch | | |

*light-fast synthetic neutralisation finishing substance, BAYER AG
**extremely light-fast synthetic white dressing substance, BAYER AG The monomer solution, consisting of 84,5 g acryamide, 35.0 sodium styrol sulfonate (80%), 173 g methacrylic acid and 260 g water were dosed within a period of 2 hours together with the hydroxylamine solution (1.6 g in 58 water), 8 g hydrogen peroxide, and 54.5 g caustic soda (45%) for 2 hours into the polymerisation vessel.

The leather produced as above was coloured deeper than leather treated with a commercial polymer finish dressing based on acrylic acid/acrylamide copolymer.

EXAMPLE 7

The polymer dressing substance described in Example 5 is used and tested for cowhide nappa:

| Cowhide | |
|---|---|
| Type: | Nappa<br>Wet blue, fold thickness 1.1–1.2 mm<br>%-data relative to fold weight |

-continued

| Cowhide | | |
|---|---|---|
| Wash | 200% water 30° C.<br>0.5% acetic acid | 10 min |
| Drain off dye bath | | |
| Neutralisation/<br>Finish dressing | 100% water 30° C.<br>2% Tanigan PC* undissolved | 15 min |
| Dyeing | 1% sodium bicarbonate 1:10<br>suspended in water<br>pH 6.5<br>Leather cross-section against bromocresol green<br>blue<br>+4% polymer dressing substance | 45 min<br><br><br><br>15 min |
| | +2% of a sulfated neats foot oil 1:4<br>diluted in water<br>1% ammonium | 10 min |
| | +5% Dyestuff, C.I. Acid Brown 326,<br>undissolved<br>+300% water 60° C.<br>1% formic acid 1:5 diluted with water<br>pH 5.3 | 90 min<br><br><br>30 min |
| Drain off dye bath | | |
| Oiling<br>Fixing | 200% water 60° C.<br>1% softening filler according to<br>DP 1 263 976 Example 1 1:5<br>in water<br>+1% dyestuff C.I. Acid brown 326 1:20<br>suspended in water<br>2× after 10 min, 1× after 20 min | 30 min |
| | +8% sulfited fish oil 1:4<br>+1% formic acid 1:5 diluted with water<br>2× after 10 mins, 1× after 20 min<br>pH 3.9 | 30 min |
| Rinse | Water 20° C. | 5 min |
| Leather racked overnight<br>abwelken<br>Hang dry<br>moisten<br>staking<br>milling<br>stretch | | |

*light-fast synthetic neutralisation dressing substance, BAYER AG

The leather treated with the polymer dressing substance according to the present invention is coloured deeper and is softer than leather that has been treated with a commercial polymer dressing substance based on acrylic acid/acrylamide copolymer.

EXAMPLE 8

100 g deionized water, 2.5 g methacrylic acid, and 1.0 g 35% hydrogen peroxide are placed in a polymerisation vessel fitted with a stirrer, thermometer, and reflux column and then heated to 90° C. The monomer solution of 80.5 g acrylamide, 47.3 g N-(3-sulfopropyl)-N-methacrylamidopropyl-N,N-dimethyl ammonium betaine, 164.7 g. methacrylic acid and 215 g was produced in another vessel. This monomer solution was then stirred for 60 min in the polymerisation vessel together with the hydroxylamine solution (1.6 g in 58 ml water), 7.8 g hydrogen peroxide (35%) and 56 g caustic soda (45%).

After polymerisation stirring was continued for 2 hours at 90° C. and finally neutralized with 112 g caustic soda (45%) to pH 7.

The solution so obtained was used for finish dressing as follows:

| Cowhide | | |
|---|---|---|
| | Upper leather<br>Wet blue fold thickness: 1.9–2.1 mm<br>%-Data relative to fold weight | |
| Neutralisation | 150% water 35° C.<br>2% sodium acetate<br>0.3% sodium bicarbonate<br>pH 5.3<br>Leather cross-section against bromcresole green:<br>blue | Undissolved 60 min |
| | +6% polymer dressing substance 1:1<br>diluted in water<br>pH 5.6 | 60 min |
| Drain off dye bath | | |
| Rinse | Water 60° C. | 10 min |
| Dyeing | 1% dyestuff C.I. Acid brown 83 1:20<br>suspended in water<br>2× after 10 min, 1× after 20 min<br>+8% of a sulfonated triglyceride with | 45 min |

-continued

| Cowhide | | |
|---|---|---|
| | paraffin sulfonate 1:4<br>+1% formic acid 1:5 diluted with water<br>pH 3.7 | 30 min |
| Drain off dye bath | | |
| Rinse | water 20° C. | 10 min |
| Rack leather overnight | | |
| Samming | | |
| scouring | | |
| hang to dry | | |
| moisten | | |
| staking | | |
| stretch | | |

The leather treated with the polymer dressing substance according to the present invention displays improved scuff resistance and was coloured deeper than leather treated with a commercial polymer finish dressing substance based on acrylic acid/acrylamide copolymer.

EXAMPLE 9

100 g water and 1.0 g 35% hydrogen peroxide were placed in a polymerisation flask as in Example 1 and heated to 90° C. The monomer solution, consisting of 136 g acrylamide, 65.0 sodium sulfonate (80%), 94 g maleic acid anhydride and 260 g water were dosed within a 2-hour period, together with the hydroxylamine solution (1.6 g in 58 g water), 8 g hydrogen peroxide, and 51.0 g caustic soda (45%) into the polymerisation flask within 2 hours.

After polymerisation stirring was continued for a further 2 hours at 90° C. and neutralized with caustic soda to pH 7.0.

The solution so obtained was used for finish dressing as follows:

| Cowhide: | | |
|---|---|---|
| Type: | upper leather:<br>Wet blue, fold thickness 1.7–1.8 mm<br>%-data relative to fold weight | |
| Neutralisation: | 150% water<br>2% sodium acetate<br>0.3% sodium bicarbonate<br>pH 5.6<br>Leather cross-section against bromcresole green: blue | 60 min |
| Finish dressing: | 6% polymer dressing substance 1:1 dissolved in water<br>pH 5.9 | 60 min |
| Drain off dye bath | | |
| Rinse | Water 60° C.<br>100% water 60° C. | 10 min |
| Dyeing/Oiling | 1% dyestuff C.I. Acid brown 83 1:20 suspended in water<br>2× after 10 min, 1× after 20 min | |
| | +8% oiling compound of synthetic and native oils | 45 min |
| | +1% formic acid 1:5 diluted with water<br>pH 3.8 | 30 min |
| Drain off dye bath | | |
| Rinse | Water 20° C. | 10 min |
| Rack leather overnight | | |
| samming | | |
| moisten | | |
| stollen | | |
| milling | | |
| stretch | | |

The leather treated with the polymer dressing substance according to the present invention displayed far greater colour intensity than leather treated with a commercial polymer finish dressing substance based on acrylic acid-/acrylamide copolymer.

EXAMPLE 10

100 g water and 4.0 g 35% hydrogen peroxide were placed in a polymerisation flask as in Example 1 and heated to 90° C. The monomer solution, consisting of 256 g acrylamide, 39.1 sodium styrol sulfonate (80%), and 260 g water were dosed within 2 hours, together with the hydroxylamine solution (6.3 g in 78 g water), 31.2 g hydrogen peroxide ito the polymerisation flask. The reaction temperature was maintained at 100° C. by simmering. After polymerisation the stirring was continued for a further 2 hours at 90° C. and neutralized to pH 7.0 with caustic soda. The solution that was obtained was used as in Example 9 and resulted in a leather whose softness, depth of colouration and brilliance was far better than in the case of leather treated with a commercial polymer finish dressing substance based on acrylic acid/acrylamide.

The embodiments of the invention in which an exclusive property or privilege is claimed are defined as follows:

1. A process for treating leathers which were previously treated by a mineral or combined method comprising contacting the leathers with an aqueous solution of a water soluble polymer derived from at least one monomer selected from the group consisting of an ethylenically unsaturated acrylic sulfonic acid, esters thereof, and an ethylenically unsaturated substituent containing aromatic sulfonic acid, salts thereof or mixtures thereof.

2. A process as in claim 1 wherein the polymer contains at least 3 mol % of units of a monomer selected from the group consisting of 2-acrylamido-2-methylpropanesulfonic acid, N-(3-sulfopropyl-N-(meth)-acrylamidopropyl)-N,N-dimethyl ammonium betaine, sulfopropyl(meth)-acrylic acid ester, styryl-sulfonic acid, an alkali salt of styrylsulfonic acid and an ammonium salt of styrylsulfonic acid.

3. A process as in claim 1 which further comprises an additional water soluble, unsaturated monomer that does not contain phosphorous, said additional monomer selected from the group consisting of monomers that contain carboxyl groups, (meth)acrylamide vinylpyrrolidone and mixtures thereof.

4. A process according to claim 3, wherein said monomers that contain carboxyl groups are selected from the group consisting of maleic acid, (meth-)acrylic acid and crotonic acid.

5. A process according to claim 1 wherein the treatment of the leather is conducted with 0.1–5.0 %-wt, relative to the fold weight of the polymer, at a dyebath length of up to 300%, at temperatures to a maximum of 70° C. and pH values in the range of from at least 2.5 to 8.0.

6. A process according to claim 1 wherein a synthetic finishing substance or a vegetable substance is used in conjunction with said polymer.

7. A process according to claim 6, wherein the synthetic finishing substance is syntane.

8. A process according to claim 1 containing at least 5 mole % of the unsaturated monomer containing a sulfonic acid group.

9. In the treating of leather including (a) contacting leather with a finish dressing, said finish dressing including a salt selected from the group consisting of trivalent chromium, aluminum, zirconium and mixtures thereof, a synthetic finish material and polymers containing carboxyl groups or copolymers based on acrylic acid, (b) contacting the leather from step (a) with a dye, (c) subjecting the leather from step (b) to an oiling procedure wherein the leather is contacted with a sulfonated triglyceride with a paraffin sulfonate, and (d) drying the leather from step (c), wherein the improvement comprises contacting the leather between steps (b) and (c) with an aqueous solution of a water soluble polymer derived from at least one monomer selected from the group consisting of an ethylenically unsaturated acrylic sulfonic acid, ester thereof, an ethylenically unsaturated substituent containing aromatic sulfonic acid, salts thereof or mixtures thereof.

* * * * *

UNITED STATES PATENT AND TRADEMARK OFFICE

CERTIFICATE OF CORRECTION

PATENT NO. : 4,631,063

DATED : December 23, 1986

INVENTOR(S) : Dolf Stockhausen, et al.

It is certified that error appears in the above-identified patent and that said Letters Patent is hereby corrected as shown below:

| | |
|---|---|
| Col. 2, line 52 | After "Prikl" delete "," and substitute --.-- |
| Col. 4, line 17 | Before "8.0g" delete "$NH_2O_4$.HCL" and substitute --$NH_2O_4$.HCl-- |
| Col. 6, last line | Extend bracket to this line |
| Col. 8, line 39 | After "undissolved" insert --30 min-- in last column |
| Col. 8, line 62 | After "cowhide" delete "nappa" and substitute --napa-- |
| Col. 9, line 36 | After "overnight" delete "abwelken" and substitute --samming-- |
| Col. 11, line 8 | Below "Rack leather overnight" delete "Samming" and substitute --samming-- |

Signed and Sealed this

First Day of December, 1987

*Attest:*

*Attesting Officer*

DONALD J. QUIGG

*Commissioner of Patents and Trademarks*